US011111736B2

(12) United States Patent
Prakash et al.

(10) Patent No.: US 11,111,736 B2
(45) Date of Patent: Sep. 7, 2021

(54) CONNECTOR RING

(71) Applicant: HALLIBURTON ENERGY SERVICES, INC., Houston, TX (US)

(72) Inventors: Anand Prakash, Tomball, TX (US); Heen Wei Ng, Singapore (SG); Minh Dang Nguyen, Singapore (SG); Chin Wee Lim, Singapore (SG)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 31 days.

(21) Appl. No.: 16/600,924

(22) Filed: Oct. 14, 2019

(65) Prior Publication Data

US 2021/0108468 A1 Apr. 15, 2021

(51) Int. Cl.
*E21B 17/02* (2006.01)
*H01R 13/631* (2006.01)
*E21B 47/26* (2012.01)

(52) U.S. Cl.
CPC ..... *E21B 17/028* (2013.01); *E21B 47/26* (2020.05); *H01R 13/631* (2013.01); *H01R 2201/14* (2013.01)

(58) Field of Classification Search
CPC ..... E21B 17/028; E21B 47/26; H01R 13/631; H01R 2201/14
See application file for complete search history.

(56) References Cited

U.S. PATENT DOCUMENTS 3,951,500 A * 4/1976 Anderson ..... H01R 13/631 439/248
4,998,892 A * 3/1991 Shiley ..... H01R 13/631 439/381
5,199,893 A * 4/1993 Fussell ..... G01V 1/201 439/271
5,624,288 A * 4/1997 Becker ..... G01V 1/181 439/784
5,769,555 A * 6/1998 Okada ..... H01R 13/422 403/14
5,864,089 A 1/1999 Rainal
6,102,751 A * 8/2000 Becker ..... H01R 13/42 439/784
6,116,965 A 9/2000 Arnett et al.
(Continued)

FOREIGN PATENT DOCUMENTS

WO 9949539 A1 9/1999

OTHER PUBLICATIONS

"Electrical Connectors and Tooling", Connector Microtooling Systems, Inc, 2004.

*Primary Examiner* — Nicole Coy
(74) *Attorney, Agent, or Firm* — Polsinelli PC

(57) ABSTRACT

A connector ring comprising a body extending along a longitudinal axis and two sets of sensor connectors. The first set of sensor connectors comprises one or more transmitter sensor connectors coupled with the body and extending parallel to the longitudinal axis, the one or more transmitter sensor connectors having a first end. The second set of sensor connectors comprises one or more receiver sensor connectors coupled with the body and extending parallel to the longitudinal axis, the one or more receiver sensor connectors having a first end. The first end of the transmitter sensor connectors and the first end of the receiver sensor connectors are staggered along the longitudinal axis.

20 Claims, 10 Drawing Sheets

(56) References Cited

U.S. PATENT DOCUMENTS

| | | | | |
|---|---|---|---|---|
| 6,331,120 | B1 | 12/2001 | Clement | |
| 7,333,391 | B2 * | 2/2008 | Chamberlain | G01V 1/201 367/20 |
| 8,573,999 | B2 | 11/2013 | Feldner et al. | |
| 8,869,887 | B2 * | 10/2014 | Deere | E21B 33/0385 166/242.7 |
| 9,065,230 | B2 | 6/2015 | Milbrand, Jr. | |
| 9,225,114 | B2 | 12/2015 | Sinclair | |
| 9,322,223 | B2 * | 4/2016 | Johnson | E21B 19/16 |
| 2003/0032339 | A1 * | 2/2003 | Bell | H01R 13/533 439/736 |

* cited by examiner

CONNECTOR RING

FIELD

The present disclosure relates generally to connector rings in downhole tools. In at least one example, the present disclosure relates to connector rings in downhole tools including both receiver and transmitter sensor connectors.

BACKGROUND

Wellbores are drilled into the earth for a variety of purposes including accessing hydrocarbon bearing formations. A variety of downhole tools may be used within a wellbore in connection with accessing and extracting such hydrocarbons. Various sensors may be included in the downhole tools which collect data regarding the wellbore and surrounding formation. The downhole tools may require instructions and/or may need to pass along data obtained by the sensors. In order to transmit and receive data, the sensors are connected to electronic components, such as controllers. The placement and manner of connecting the sensors is often constrained by the small space available in the downhole tools.

BRIEF DESCRIPTION OF THE DRAWINGS

Implementations of the present technology will now be described, by way of example only, with reference to the attached figures, wherein.

DETAILED DESCRIPTION

Figure 1:
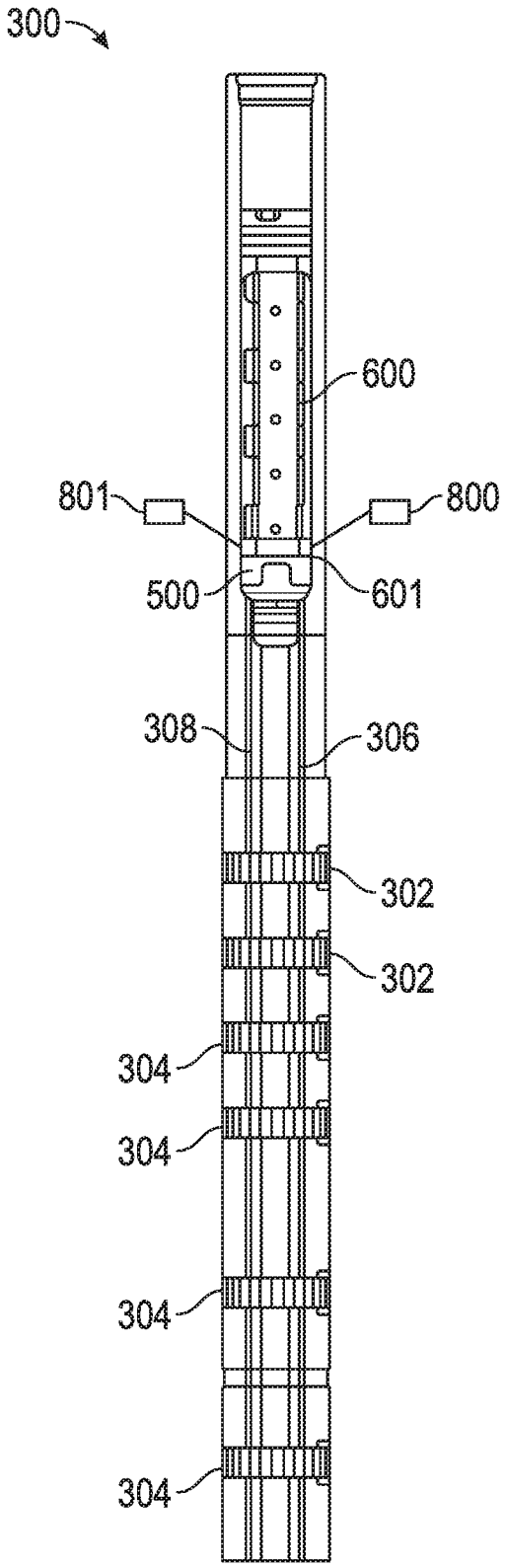
FIG. 1 is a diagram illustrating a downhole tool with a connector ring according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Disclosed herein is a connector ring for use in a transmitter and receiver based downhole tool, which can include any or all of the following features or aspects in any given example. A transmitter and receiver based downhole tool may communicate and exchange signals with a surface device like a surface computer to control the downhole tool and to receive sensor data collected by the downhole tool. To allow for such information exchange, the tool is equipped with an electronics carrier to control the operation of the downhole tool, as well as regulate the content and timing of signal transmissions between the surface computer and the downhole. The downhole tool is also equipped with transmitter sensors and receiver sensors that may act as antennas to transmit and receive signals, respectively. The electronics carrier is communicatively and structurally coupled with the transmitter and receiver sensors via a connector ring structure.

Proximity between transmitter electronics and receiver electronics may lead to unwanted coupling between the transmitter and receiver signals. This unwanted coupling is known as crosstalk, and may lead to undesired behavior such as measurement offset and/or errors. Conventionally, designs of downhole tools separate the transmitter and receiver electronics to reduce crosstalk between transmitter and receiver signals. However, designs that use separate connector rings and electronics carriers for transmitters and receivers may increase the length and cost of transmitter/receiver sensor based tools. The present disclosure provides a staggered connector ring assembly structure to combine the use of receiver and transmitter electronics such that only one connector ring and one electronics carrier is used in a logging tool, while maintaining a separation between receiver and transmitter signals. This may result in reduced logging tool length and cost, while also reducing crosstalk between receiver and transmitter signals.

An example configuration is as follows. The connector ring includes sensor connectors that couple with transmitter and receiver sensors on one end, and with corresponding carrier connectors of an electronics carrier on the other end, thereby communicatively coupling the sensors and electronics carrier. The sensor connectors coupled with the receiver sensors are staggered on one end relative to the sensor connectors coupled with the transceiver sensors along the axial length of the connector ring body. Furthermore, the respective carrier connectors of the electronic carriers are staggered along the axial length of the connector ring body in a corresponding manner.

So as to describe the relative orientation of components, the connector ring includes a body that extends along a longitudinal axis. On a first end of the connector ring, there are sensor connectors on two distinct planes, a first set of sensor connectors on a first connector plane and a second set of sensor connector on a second connector plane. The first connector plane and the second connector plane are staggered in the longitudinal direction a first distance apart. In at least one example, one set of sensor connectors is connected to one or more receiver sensors, and the other set of sensor connectors is connected to one or more transmitter sensors. The coupling between the sensor connectors and the receiver and transmitter sensors may be direct, or may use one or more receiver and transmitter sensor cables. The connector ring couples with an electronics carrier that corresponds to the connector ring in shape and size. The electronics carrier may have batteries, directional sensors (e.g., magnetometers, accelerometers, gamma ray sensors, inclinometers, etc.), one or more processing units, memory, and downhole telemetry components. The electronics carrier may perform many operations. For example, it may be used to communicate signals to and from the downhole tool, to control the operation of the downhole tool, to receive sensor data from the downhole tool, and to process data.

The electronics carrier includes a body extending along the longitudinal axis. On a first end of the electronics carrier, there are carrier connectors on two distinct planes, a first set of carrier connectors on a first carrier plane and a second set of carrier connectors on a second carrier plane. The first end of the connecter ring may couple with the first end of the carrier such that the first set of sensor connectors couples with the first set of carrier connectors, and the second set of sensor connectors couples with the second set of carrier connectors. The first carrier plane and the second carrier plane are staggered in the longitudinal direction a second distance apart such that they correspond to the first connector plane and the second connector plane.

For example, a connector ring with the first connector plane extending the first distance further than the second connector plane may couple with an carrier with the second carrier plane extending a second distance further than the first carrier plane, where the second distance is equal to the first distance.

In another example, a connector ring with the second connector plane extending the first distance further than the first connector plane may couple with an carrier with the first carrier plane extending a second distance further than the second carrier plane, where the second distance is equal to the first distance.

The connector ring and its corresponding electronics carrier may be utilized in downhole tools, for example, measuring or logging while drilling (M/LWD) tools or any transmitter and receiver based tools. A tool using the disclosed connector ring and its corresponding carrier may reduce system complexity and run its receiver sensor cables and transmitter sensor cables in the same direction, for example, in the uphole or the downhole direction. The staggered connectors between the connector ring and the carrier may reduce crosstalk between high-frequency receiver and transmitter signals. The reduced crosstalk of the transmitter and receiver sensor cables increases signal-to-noise ratio (SNR) of the system and enables measurements with higher accuracy.

The connector ring acts as an interface between the electronics carrier and the transmitter sensors and receiver sensors. With the connector ring assembly as disclosed herein, a downhole tool may use a singular connector ring for both transmitter and receiver signals.

FIG. 1 is a diagram illustrating a downhole tool with a connector ring according to the present disclosure. As shown, the connector ring 500 acts as an interface between the electronics carrier 600 and the transmitter sensors 304 and receiver sensors 302. With the connector ring assembly 500 as disclosed herein, a downhole tool 300 may use a singular connector ring 500 for both transmitter and receiver signals. As illustrated in FIG. 1, a first end of the connector ring 500 connects to one or more receiver sensors 302 with receiver sensor cables 306, and to one or more transmitter sensors 304 with transmitter sensor cables 308. In some examples, the connector ring 500 can directly couple to the sensors 302 and 304 without the use of receiver and transmitter sensor cables 306 and 308. A second end of the connector ring 500 can be coupled to an electronics carrier 600 by attaching the connecting region 601 of the electronics carrier 600 to the connector ring 500.

Figure 2:
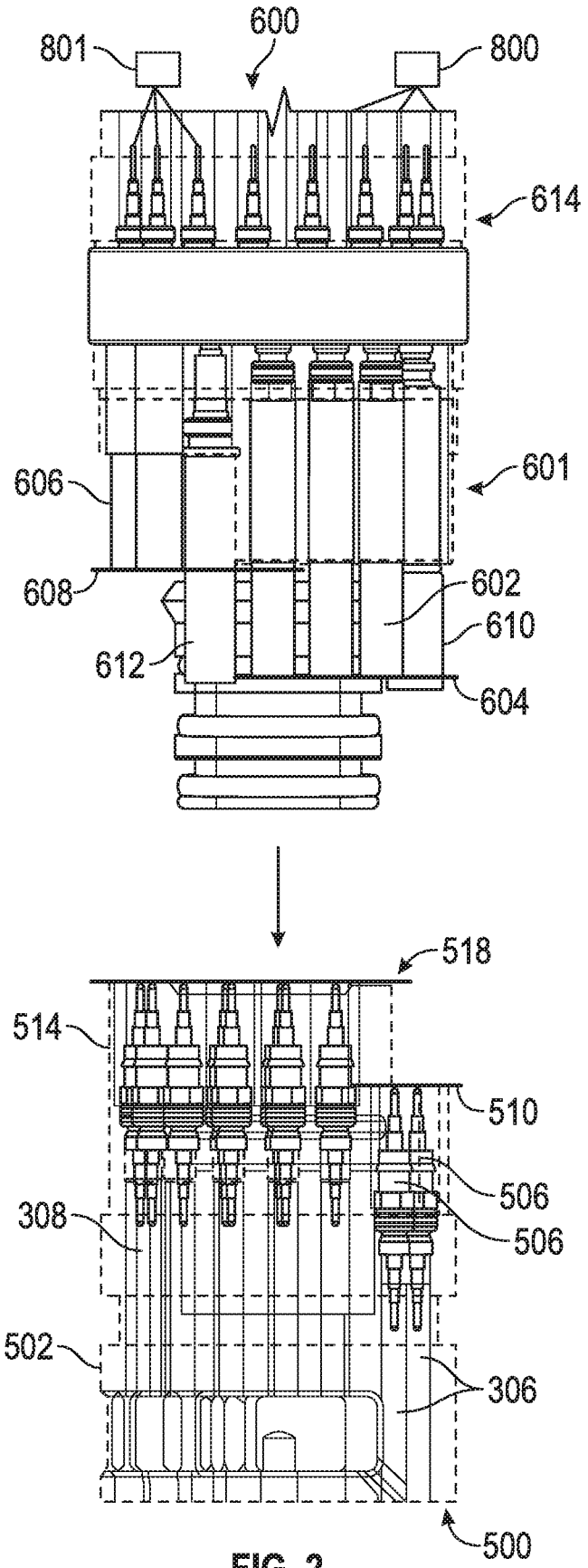
FIG. 2 is a diagram illustrating a connector ring and an electronics carrier, in accordance with various aspects of the present disclosure.

FIG. 2 is a diagram illustrating an example of the coupling between connector ring 500 and electronics carrier 600. As shown by the arrow pointing downward from electronics carrier 600 to connector ring 500, the two can be coupled together. The connector ring 500 includes a body 502 extending along a longitudinal axis. One or more transmitter sensor connectors 514 couple with the body 502 of the connector ring 500. The one or more transmitter sensor connectors 514 have a first end 570 at a first plane 518 and a second end 572 coupled with transmitter sensor cables 308. The connector ring 500 also includes one or more receiver sensor connectors 506. The one or more receiver sensor connectors 506 couple with the body 502 of the connecter ring 500. The one or more receiver sensor connectors 506 have a first end 580 at a second plane 510 and a second end 582 coupled with receiver sensor cables 306. To reduce crosstalk between the transmitter signals communicated via the receiver sensor cables 306 and transmitter sensor cables 308, the first end 570 of the transmitter sensor connectors 514 and the first end 580 of the receiver sensor connectors 506 are staggered along the longitudinal axis. The distance of staggering between first end 570 of the transmitter sensor connectors 514 and the first end 580 of the receiver sensor connectors 506 may be predetermined.

The receiver sensor connectors 506 and transmitter sensor connectors 514 are used to establish a communication link between the electronics carrier 600 and the receiver sensors 302 and transmitter sensors 304. In at least one example, such as the one shown in FIG. 2, the receiver sensor connectors 506 and transmitter sensor connectors 514 are dual male end connector pins made out of a conductive material such as metal.

Note that while the connector ring 500 and electronics carrier 600 are shown to have circular cross sections in FIGS. 1-4B, connector ring 500 and electronics carrier 600 may take on other shapes, for example, square, rectangle, ellipse, or hexagon.

The electronics carrier 600 comprises a body 614 extending in the longitudinal direction. The electronics carrier body 614 may contain the necessary electronics used to receive and transmit signals, to process signals, and/or to control the downhole tool 300. Coupled to the electronics carrier body 614 is a connector portion 601, which is used to engage the connector ring 500. The connector portion 601 includes one or more carrier transmitter connectors 606 that have a first end 650 on plane 608 and a second end 652 that extends into the electronics carrier body 614, and one or more carrier receiver connectors 602 that have a first end 660 on plane 604 and a second end 662 that extends into the electronics carrier body 614. The carrier receiver connectors 602 are of corresponding shapes and sizes of the receiver sensor connectors 506. The carrier transmitter connectors 606 are of corresponding shapes and sizes of the transmitter sensor connectors 514. When the connector ring 500 couples with the electronics carrier 600, the one or more carrier transmitter connectors 606 couple with the corresponding transmitter sensor connectors 514, and the one or more carrier receiver connectors 602 couple with the corresponding receiver sensor connectors 506.

Figure 3A:
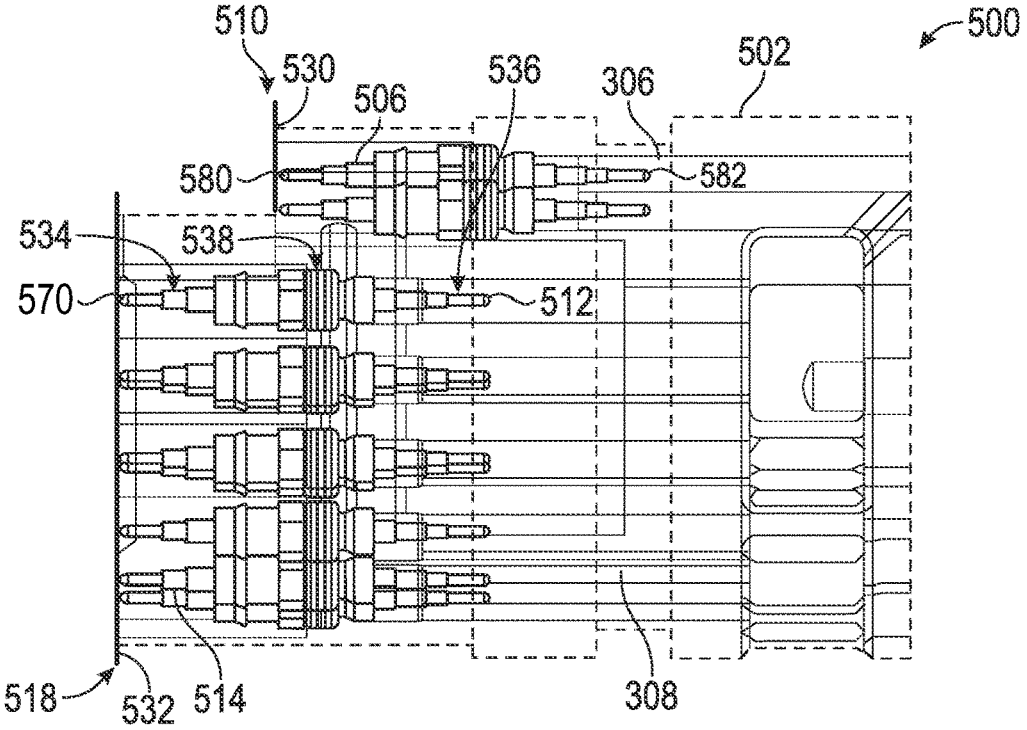
FIG. 3A is a diagram illustrating a connector ring with receiver sensor connectors and transmitter sensor connectors, in accordance with various aspects of the present disclosure.

FIG. 3A is a diagram illustrating a connector ring with receiver sensor connectors and transmitter sensor connectors. As shown in FIG. 3A, as well as shown in FIG. 2, the second connector plane 510 coupled to the receiver sensor connectors 506 is extended further in the longitudinal direction than the first plane 518 of the transmitter sensor connectors 514. As a result, the distance between the first end 570 of the transmitter sensor connectors 514 and the body 502 of the connector ring 500 is greater than the distance between the first end 580 of the receiver sensor connectors 506 and the body 502 of the connector ring 500. Correspondingly, the first carrier plane 608 of the carrier transmitter connectors 606 extends further than the second carrier plane 604 of the carrier receiver connectors 602, and the distance between the first end 650 of the carrier transmitter connectors 606 and the body 614 of electronics carrier 600 is greater than the distance between the first end 660 of the carrier receiver connectors 602 and the body 614 of electronics carrier 600. In the example shown in FIG. 3A, the receiver sensor connectors 506 and transmitter sensor connectors 514 are dual male end connector pins with a first male end 534 that couples the electronics carrier 600, a second male end 536 that couples with receiver sensor cables 306 or transmitter sensor cables 308, and an intermediate portion 538.

In some examples, the first connector plane 518 of the transmitter sensor connectors 514 may extend further in the longitudinal direction than the second connector plane 510 of the receiver sensor connectors 506; in such examples, the second carrier plane 604 of the carrier receiver connectors 602 may extend further in the longitudinal direction than the first carrier plane 608 of the carrier transmitter connectors 606. Correspondingly, the first end 580 of the receiver sensor connectors 506 may extend further in the longitudinal direction than the first end 570 of the transmitter sensor connectors 514, and the first end 660 of the carrier receiver connectors 602 may extend further in the longitudinal direction than the first end 650 of the carrier transmitter connectors 606.

In some examples, the receiver sensor connectors 506 and the transmitter sensor connectors 514 are of the male connector type. In such examples, the respective carrier receiver connectors 602 and the carrier transmitter connectors 606 are of the corresponding female type to allow for successful coupling.

In some examples, the receiver sensor connectors 506 and the transmitter sensor connectors 514 are of the female connector type. In such examples, the respective carrier receiver connectors 602 and the carrier transmitter connectors 606 are of the corresponding male type to allow for successful coupling.

Figure 3B:
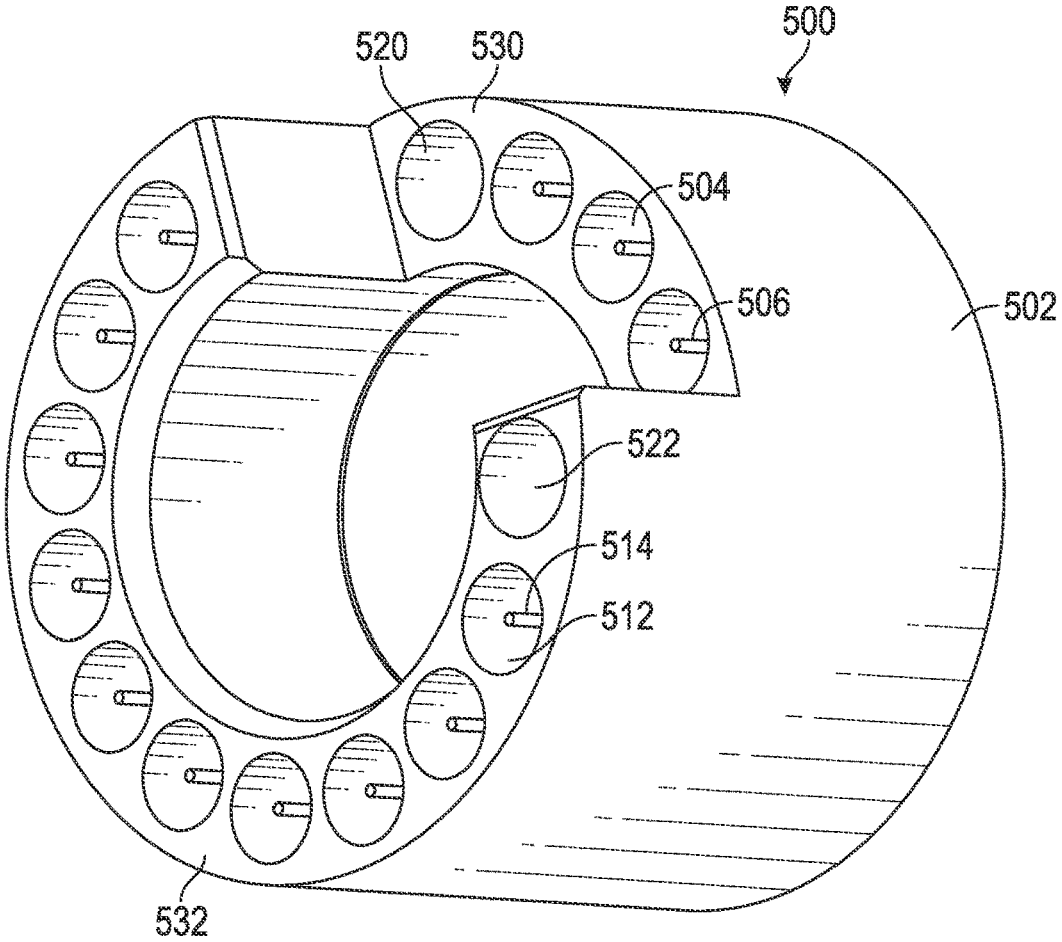
FIG. 3B is an isometric view of FIG. 3A.
Figure 3C:
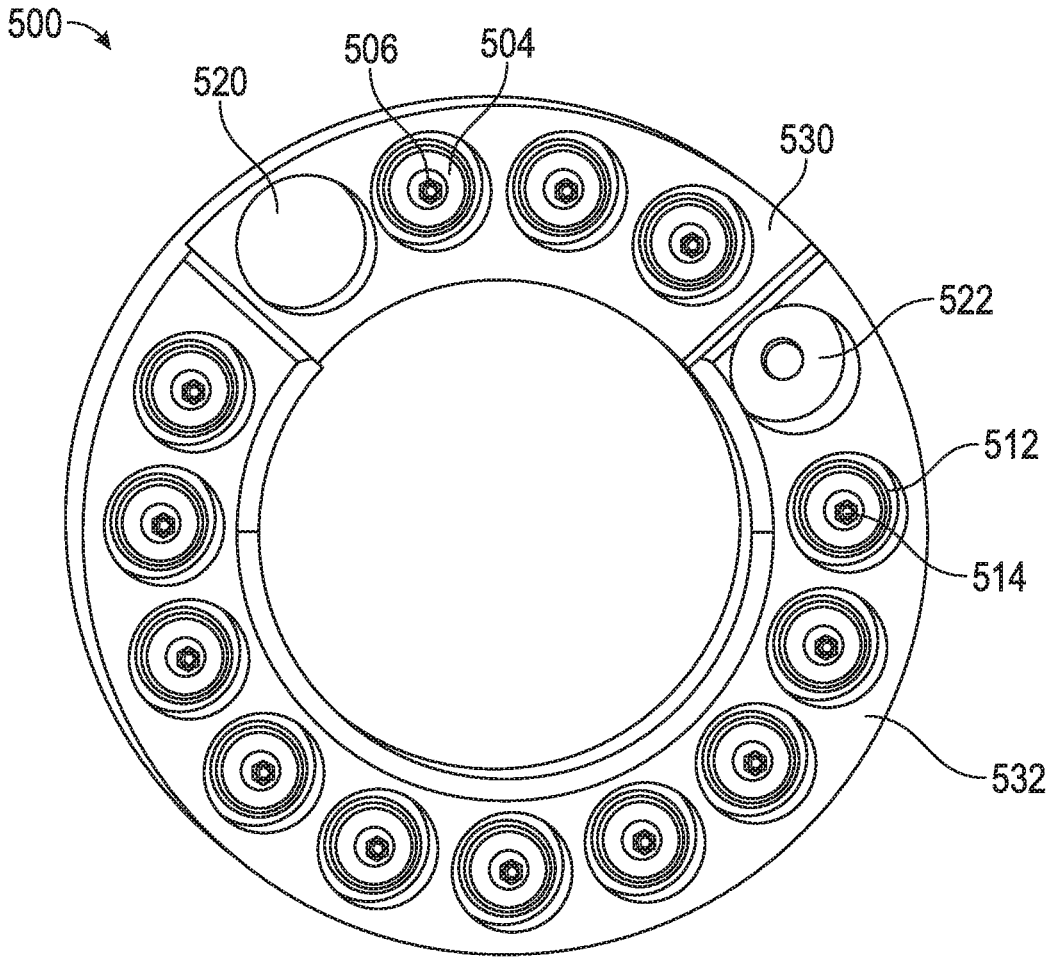
FIG. 3C is a front view of FIG. 3A.

In some examples, the transmitter sensor connectors 514 and receiver sensor connectors 506 are male type connectors placed in wells 504 and wells 512, respectively. FIG. 3B is an isometric view of FIG. 3A. In this FIG. 3B, it can be seen that the wells 504 and wells 512 are circular in shape, but may take on other shapes, for example, square, rectangle, or ellipse. In at least one example, the coupling of the connector ring 500 and the electronics carrier 600 involves the use of alignment pins.

When coupling the connector ring 500 and the electronics carrier 600, alignment pins are able to orient and position the connector ring 500 and the electronics carrier 600 to ease the coupling process and reduce damage to the transmitter sensor connectors 514 and receiver sensor connectors 506. The alignment pins 610, 612 may be manufactured using a flexible material to allow for a wider range of motion in the coupling process.

Figure 4A:
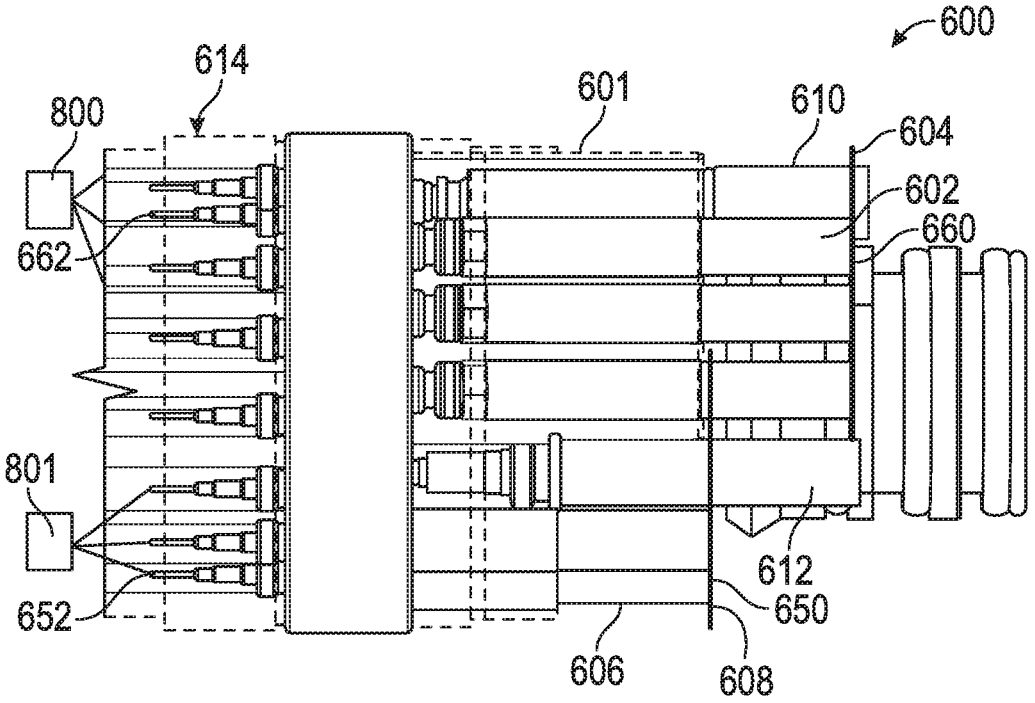
FIG. 4A is a diagram illustrating an electronics carrier, in accordance with various aspects of the present disclosure.
Figure 4B:
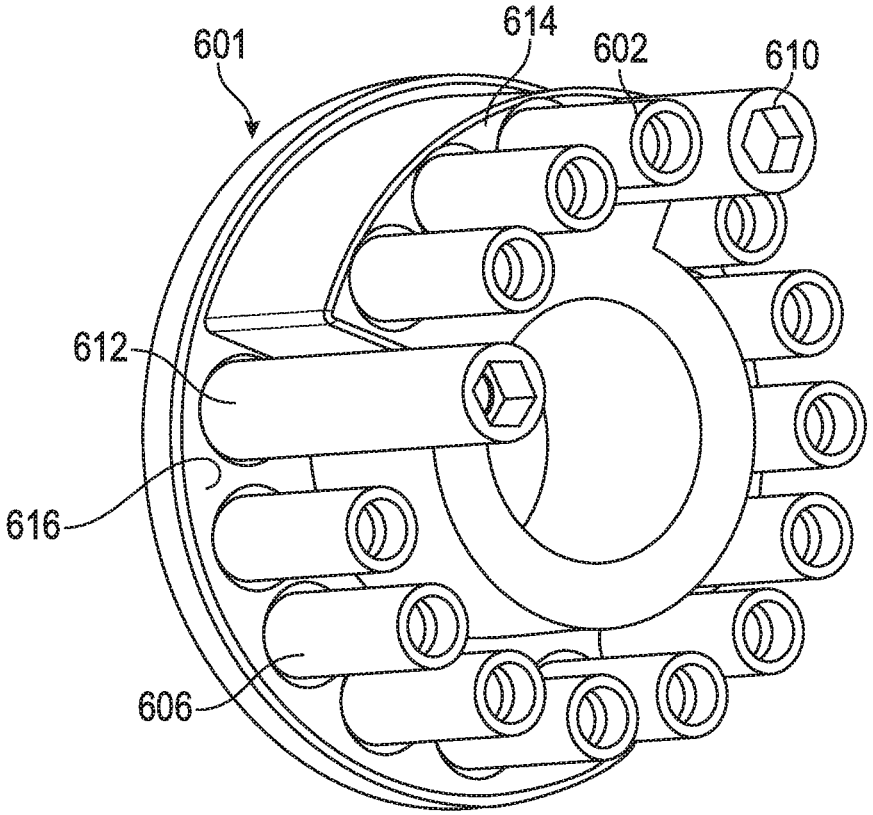
FIG. 4B is an isometric view of FIG. 4A.

FIGS. 4A and 4B are diagrams illustrating an electronics carrier 600, in accordance with various aspects of the present disclosure. As illustrated in FIG. 4A and FIG. 4B, alignment pins 610, 612 are coupled to the connecting region 601 of the electronics carrier 600. Alignment pins 610, 612 may extend further in the longitudinal direction than the carrier transmitter connectors 606 and the carrier receiver connectors 602 such that the alignment pins 610, 612 ensure that the connector ring 500 and the electronics carrier 600 are correctly aligned before the carrier receiver connectors 602 and the carrier transmitter connectors 606 are coupled with the transmitter sensor connectors 514 and receiver sensor connectors 506. Accordingly, by being correctly aligned, damage to the carrier receiver connectors 602, the carrier transmitter connectors 606, the transmitter sensor connectors 514, and receiver sensor connectors 506 during coupling may be avoided.

As shown in FIG. 4A and FIG. 4B, a first alignment pin 610 is on a higher shoulder 618 of the connecting region 601 of the electronics carrier 600. A second alignment pin 612 is on a lower shoulder 616 of the connecting region 601 of the electronics carrier. The first alignment pin 610 couples with a first alignment connector 520 on the lower shoulder 530 of the connector ring 500. The second alignment pin 612 couples with a second alignment connector 522 on the higher shoulder 532 of the connector ring 500.

In some examples, the first alignment pin 610 and the second alignment pin 612 may differ in size or shape. The alignment connectors 520 and 522 may have corresponding sizes and shapes to the first alignment pin 610 and the second alignment pin 612, respectively, to allow for successful coupling between the connector ring 500 and the electronics carrier 600. For example, the first alignment pin 610 may have a looser connection with the first alignment connector 520 than the second alignment pin 612 and the second alignment connector 522. As such, the first alignment pin 610 can be coupled with the first alignment connector 520 without too much precision needed while the second alignment pin 612 and the second alignment connector 522 can be coupled with greater precision to confirm the alignment of the connector ring 500 and the electronics carrier 600.

In some examples, more than one alignment pin may be included on the higher shoulder 618 or the lower shoulder 616 of the connecting region 601 of the electronics carrier 600. The lower shoulder 530 and the higher shoulder 532 of the connector ring 500 would have corresponding numbers and placements of alignment connectors to allow for successful coupling between the connector ring 500 and the electronics carrier 600.

In some examples, the first alignment pin 610 and the second alignment pin 612 may be replaced with a set of female connectors and the first alignment connector 520 and the second alignment connector 522 may be corresponding male connectors that are able to couple with the set of female connectors.

Figure 5:
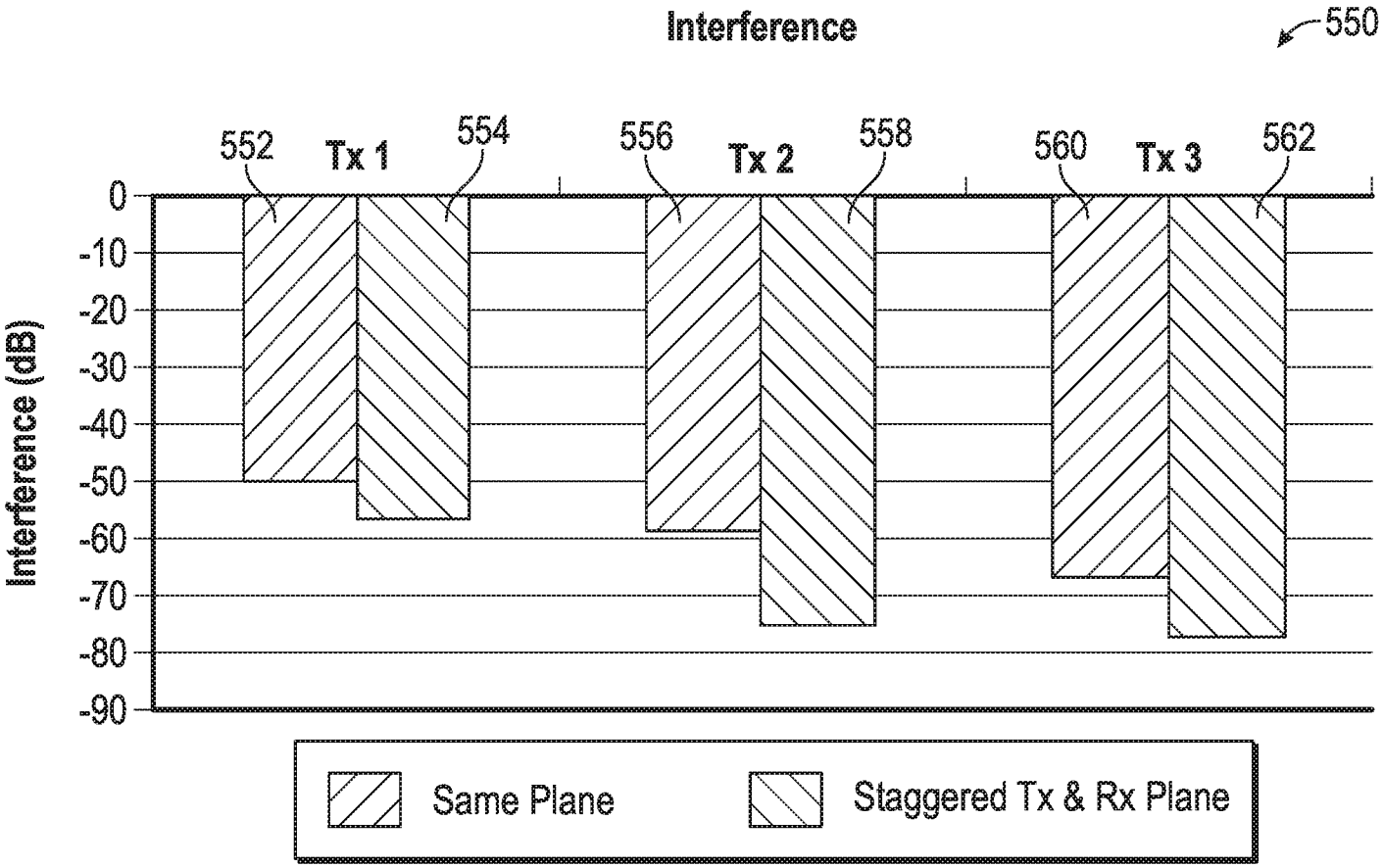
FIG. 5 is a chart comparing interference with staggered receiver and transmitter sensor connectors and sensor connectors on the same plane, in accordance with various aspects of the present disclosure.

By staggering the receiver connectors 602 and receiver sensor connectors 506, and the transmitter connectors 606 and transmitter sensor connectors 514 between the connector ring 500 and electronics carrier 600, the downhole tool 300 disclosed herein is able to reduce the crosstalk between the receiver and transmitter signals. FIG. 5 depicts a chart 550 comparing interference with staggered receiver and transmitter sensor connectors and sensor connectors on the same plane. The amount of crosstalk present in downhole tools with transmitter and receiver connections on the same plane is plotted in FIG. 5 as 552, 556, and 560. The amount of crosstalk present in downhole tools with transmitter and receiver connections on staggered planes is plotted in FIG. 5 as 554, 558, and 562. A comparison between corresponding measurements, between 552 and 554, 556 and 558, and 560 and 562 shows a reduction in crosstalk when using a staggered connector ring 500 as indicated by the more negative interference (dB) values.

Once the receiver and transmitter signals are sent to the electronics carrier 600, the signals are processed using processing systems. The receiver signals are processed using receiver processing system 801, and the transmitter signals are processed using the transmitter processing system. The processing systems 800 and 801 may perform various operations on the signals. For example, the signals may be stored in memory, analyzed to produce statistics, analyzed to produce predictions, analyzed to determine the operation of downhole tool 300, or sent to other processors for further processing.

Figure 6:
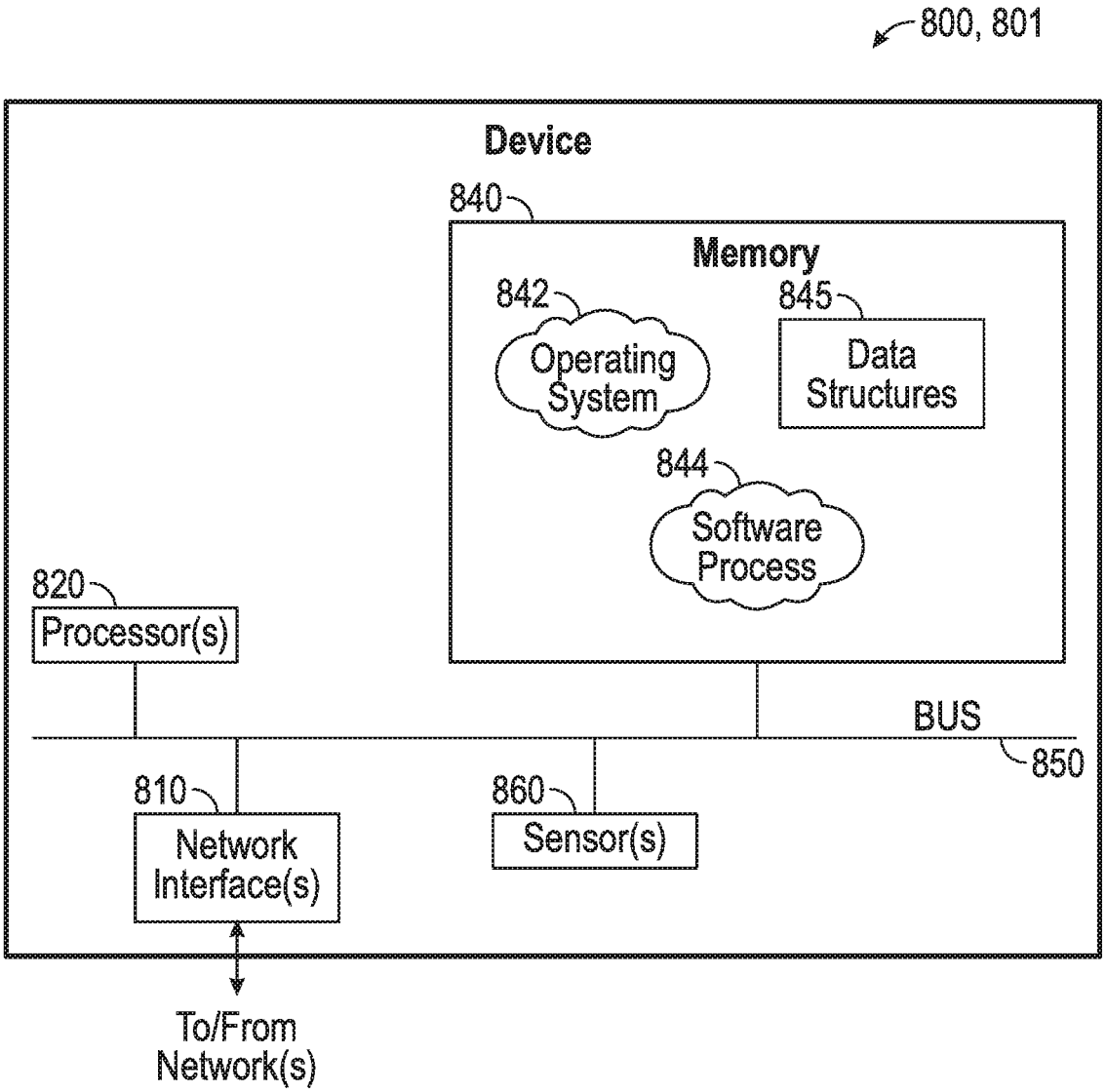
FIG. 6 is a diagram of a processing system which may be employed as shown in FIGS. 1-5.

FIG. 6 is a block diagram of an exemplary processing system for processing systems 800, 801. Processing systems 800, 801 are configured to perform processing of data and communicate with one or more of the above-discussed components and may also be configured to communication with remote devices/systems.

As shown, processing systems 800, 801 include hardware and software components such as network interfaces 810, at least one processor 820, sensors 860 and a memory 840 interconnected by a system bus 850. Network interface(s) 810 can include mechanical, electrical, and signaling circuitry for communicating data over communication links, which may include wired or wireless communication links. Network interfaces 810 are configured to transmit and/or receive data using a variety of different communication protocols, as will be understood by those skilled in the art.

Processor 820 represents a digital signal processor (e.g., a microprocessor, a microcontroller, or a fixed-logic processor, etc.) configured to execute instructions or logic to perform tasks in a wellbore environment. Processor 820 may include a general purpose processor, special-purpose processor (where software instructions are incorporated into the processor), a state machine, application specific integrated circuit (ASIC), a programmable gate array (PGA) including a field PGA, an individual component, a distributed group of processors, and the like. Processor 820 typically operates in conjunction with shared or dedicated hardware, including but not limited to, hardware capable of executing software and hardware. For example, processor 820 may include elements or logic adapted to execute software programs and manipulate data structures 845, which may reside in memory 840.

Sensors 860, which may include sensors of downhole tools 300 as disclosed herein, typically operate in conjunction with processor 820 to perform measurements, and can include special-purpose processors, detectors, transmitters, receivers, and the like. In this fashion, sensors 860 may include hardware/software for generating, transmitting, receiving, detection, logging, and/or sampling magnetic fields, seismic activity, and/or acoustic waves, temperature, pressure, radiation levels, casing collar locations, weights, torques, tool health (such as voltage levels and current monitors), accelerations, gravitational fields, strains, video recordings, flow rates, solids concentration, solids size, chemical composition, and/or other parameters.

Memory 840 comprises a plurality of storage locations that are addressable by processor 820 for storing software programs and data structures 845 associated with the embodiments described herein. An operating system 842, portions of which may be typically resident in memory 840 and executed by processor 820, functionally organizes the device by, inter alia, invoking operations in support of software processes and/or services 844 executing on processing systems 8001 and 801. These software processes and/or services 844 may perform processing of data and communication with processing systems 800 and 801, as described herein. Note that while process/service 844 is shown in centralized memory 840, some examples provide for these processes/services to be operated in a distributed computing network.

It will be apparent to those skilled in the art that other processor and memory types, including various computer-readable media, may be used to store and execute program instructions pertaining to the fluidic channel evaluation techniques described herein. Also, while the description illustrates various processes, it is expressly contemplated that various processes may be embodied as modules having portions of the process/service 844 encoded thereon. In this fashion, the program modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 820 or computer readable medium encoded with instructions for execution by processor 820 that, when executed by the processor, are operable to cause the processor to perform the functions described herein.

Figure 7:
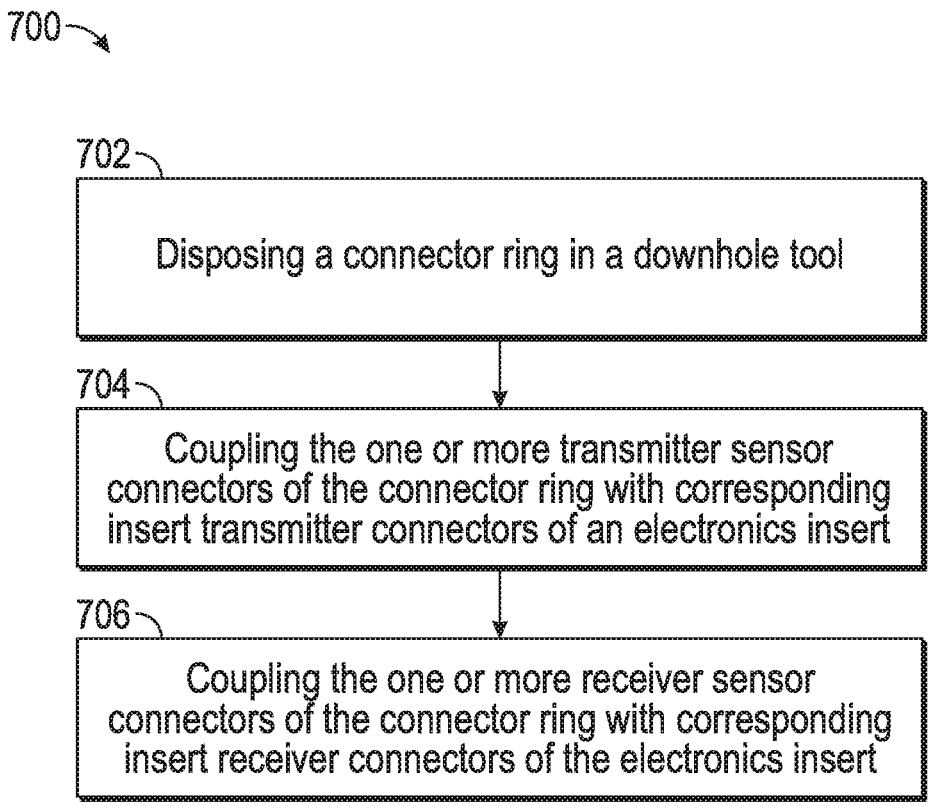
FIG. 7 is a flow chart of a method for utilizing a connector ring according to the present disclosure, in accordance with various aspects of the present disclosure.

Referring to FIG. 7, a flowchart is presented in accordance with an example embodiment. The method 700 is provided by way of example, as there are a variety of ways to carry out the method. The method 700 described below can be carried out using the configurations illustrated in FIGS. 1-4B, for example, and various elements of these figures are referenced in explaining example method 700. Each block shown in FIG. 7 represents one or more processes, methods or subroutines, carried out in the example method 700. Furthermore, the illustrated order of blocks is illustrative only and the order of the blocks can change according to the present disclosure. Additional blocks may be added or fewer blocks may be utilized, without departing from this disclosure. The example method 700 can begin at block 702.

At block 702, the connector ring is disposed in a downhole tool. The connector ring including connectors that are communicatively coupled to receiver sensors and transmitter sensors through receiver sensor connectors and transmitter sensors, respectively. At block 704, the transmitter sensor connectors are coupled with the corresponding carrier transmitter connectors. In block 706, the receiver sensor connectors are coupled with the corresponding carrier receiver connectors. The transmitter sensor connectors and the receiver sensor connectors are misaligned in the longitudinal direction. Note that a first alignment connecter may be coupled with a corresponding first alignment pin of the electronics carrier, and a second alignment connector may be coupled with a corresponding second alignment pin of the electronics carrier.

Figure 8A:
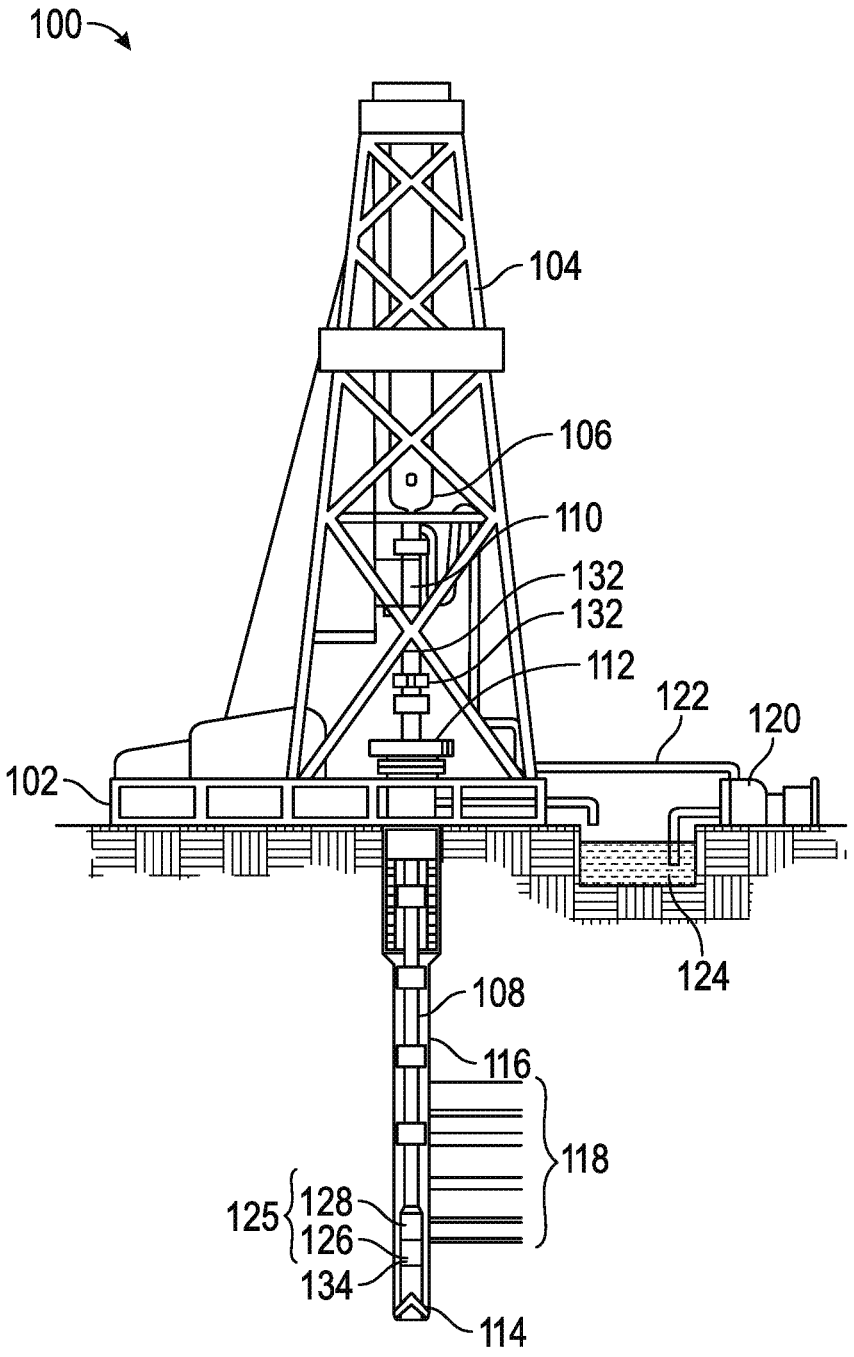
FIG. 8A is a diagram illustrating an exemplary environment for a downhole tool with a connector ring according to the present disclosure.

The connector ring can be employed in an exemplary wellbore operating environment 100 shown, for example, in FIG. 8A. FIG. 8A illustrates a schematic view of a wellbore operating environment 100 in accordance with some examples of the present disclosure. As depicted in FIG. 8A, a drilling platform 102 can be equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, the drill bit 114 creates a wellbore 116 that passes through various subterranean formations 118. A pump 120 circulates drilling fluid through a supply pipe 122 to top drive 110, down through the interior of drill string 108 and orifices in drill bit 114, back to the surface via the annulus around drill string 108, and into a retention pit 124. The drilling fluid transports cuttings from the wellbore 116 into the retention pit 124 and aids in maintaining the integrity of the wellbore 116. Various materials can be used for drilling fluid, including oil-based fluids and water-based fluids.

The drill string 108 may include the downhole tool 300 of FIG. 1. For instance, logging tools 126, which may be or include a downhole tool 300 and/or connector ring 500 of FIG. 1, can be integrated into the bottom-hole assembly 125 near the drill bit 114 for carrying out measure while drilling (MWD) or logging while drilling (LWD) operations. As the drill bit 114 extends the wellbore 116 through the formations 118, logging tools 126 collect measurements relating to various formation properties as well as the orientation of the tool and various other drilling conditions. The bottom-hole assembly 125 may also include a telemetry sub 128 to transfer measurement data to a surface receiver 132 and to receive commands from the surface. In at least some cases, the telemetry sub 128 communicates with a surface receiver 132 using mud pulse telemetry. In some instances, the telemetry sub 128 does not communicate with the surface, but rather stores logging data for later retrieval at the surface when the logging assembly is recovered.

Each of the logging tools 126 may include one or more tool components spaced apart from each other and communicatively coupled by one or more wires and/or other media for LWD and MWD operations. The logging tools 126 may also include one or more computing devices 134 communicatively coupled with one or more of the tool components by one or more wires and/or other media. The one or more computing devices 134 may be configured to control or monitor a performance of the tool, process logging data, and/or carry out one or more aspects of the methods and processes of the present disclosure.

In at least one example, one or more of the logging tools 126 may communicate with a surface receiver 132 by a wire, such as wired drillpipe. In other cases, the one or more of the logging tools 126 may communicate with a surface receiver 132 by wireless signal transmission. In at least some cases, one or more of the logging tools 126 may receive electrical power from a wire that extends to the surface, including wires extending through a wired drillpipe.

Figure 8B:
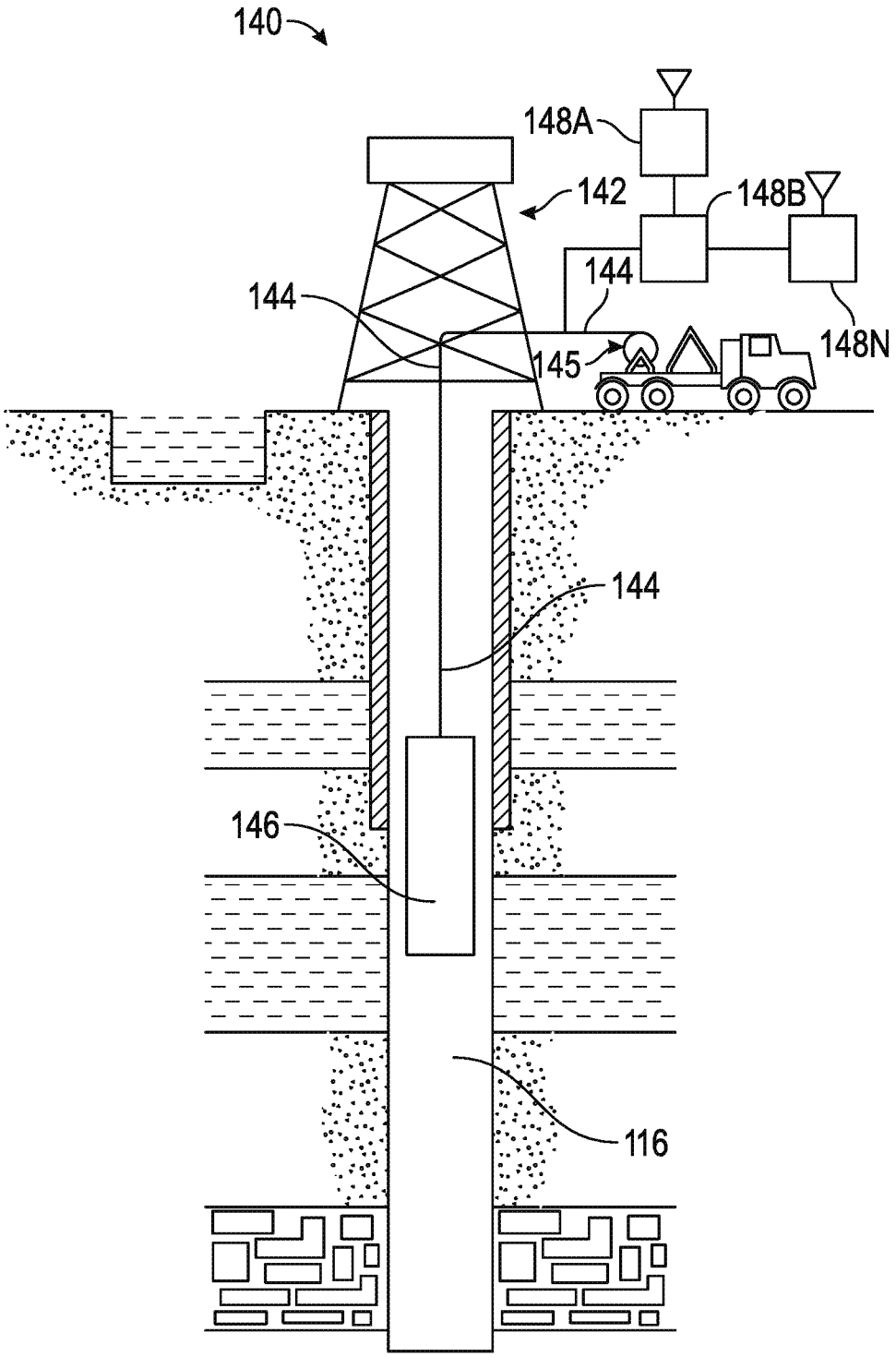
FIG. 8B is a diagram illustrating another exemplary environment for a downhole tool with a connector ring according to the present disclosure.

Referring to FIG. 8B, an example system 140 for downhole line detection in a downhole environment can employ a tool having a tool body 146 in order to carry out logging and/or other operations. The tool body 146 may be or include a downhole tool 300 and/or connector ring 500 of FIG. 1. In this environment, rather than using a drill string 108 of FIG. 8A to lower tool body 146 and which can contain sensors and/or other instrumentation for detecting and logging nearby characteristics and conditions of the wellbore 116 and surrounding formations, the drill string can be withdrawn and a conduit 144 employed (referred to as "wireline" in the field). The tool body 146 can include a resistivity logging tool. The tool body 146 can be lowered into the wellbore 116 by conduit 144. The conduit 144 can be anchored in the drill rig 145 or by a portable means such as a truck. The conduit 144 can include one or more wires, slicklines, cables, and/or the like, as well as tubular conduits such as coiled tubing, joint tubing, or other tubulars.

The illustrated conduit 144 provides power and support for the tool, as well as enabling communication between tool processors 148A-N on the surface. In some examples, the conduit 144 can include electrical and/or fiber optic cabling for carrying out communications. The conduit 144 is sufficiently strong and flexible to tether the tool body 146 through the wellbore 116, while also permitting communication through the conduit 144 to one or more processors 148A-N, which can include local and/or remote processors. Moreover, power can be supplied via the conduit 144 to meet power requirements of the tool. For slickline or coiled tubing configurations, power can be supplied downhole with a battery or via a downhole generator.

It should be noted that while FIGS. 8A and 8B generally depict a land-based operation, those skilled in the art would readily recognize that the principles described herein are equally applicable to operations that employ floating or sea-based platforms and rigs, without departing from the scope of the disclosure. Also, even though FIGS. 8A and 8B depict a vertical wellbore, the present disclosure is equally well-suited for use in wellbores having other orientations, including horizontal wellbores, slanted wellbores, multilateral wellbores or the like.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

Numerous examples are provided herein to enhance understanding of the present disclosure. A specific set of statements are provided as follows.

Statement 1: A connector ring is disclosed comprising: a body extending along a longitudinal axis; a transmitter sensor connector coupled with the body and extending parallel to the longitudinal axis, the transmitter sensor connector having a first end; a receiver sensor connector coupled with the body and extending parallel to the longitudinal axis, the receiver sensor connector having a first end, wherein the first end of the transmitter sensor connector and the first end of the receiver sensor connector are staggered along the longitudinal axis.

Statement 2: A connector ring is disclosed according to Statement 1, wherein the transmitter sensor connector and the receiver sensor connector are misaligned in the longitudinal direction.

Statement 3: A connector ring is disclosed according to Statements 1 or 2, wherein the transmitter sensor connector is operable to couple with a corresponding transmitter sensor cable.

Statement 4: A connector ring is disclosed according to any of preceding Statements 1-3, wherein the receiver sensor connector is operable to couple with a corresponding receiver sensor cable.

Statement 5: A connector ring is disclosed according to any of preceding Statements 1-4, wherein the first end of the transmitter sensor connector and the first end of the receiver sensor connector are staggered by a predetermined distance.

Statement 6: A connector ring is disclosed according to any of preceding Statements 1-5, wherein the first end of the transmitter sensor connector is located further away from the body than the first end of the receiver sensor connector.

Statement 7: A connector ring is disclosed according to any of preceding Statements 1-6, wherein the staggering of the transmitter sensor connector and the receiver sensor connector reduces crosstalk.

Statement 8: A connector ring is disclosed according to any of preceding Statements 1-7, further comprising: a plurality of alignment connectors parallel to the longitudinal axis, the alignment connectors being operable to couple with corresponding alignment pins of an electronics carrier.

Statement 9: A system is disclosed comprising: a downhole tool disposed in a wellbore operable to make measurements of the wellbore, the downhole tool having a transmitter operable to transmit data from the downhole tool, and a receiver operable to receive data from a source external the downhole tool; a connector ring coupled with the downhole tool, the connector ring comprising: a connector ring body having a longitudinal axis, a transmitter sensor connector coupled with the connector ring body and extending parallel to the longitudinal axis, the transmitter sensor connector being coupled to the transmitter sensor, the transmitter sensor connector having a first end, and a receiver sensor connector coupled with the body and extending parallel to the longitudinal axis, the receiver sensor connector having a first end, wherein the first end of the transmitter sensor connector and the first end of the receiver sensor connector are staggered along the longitudinal axis; and an electronics carrier operable to be coupled with the connector ring, the electronics carrier including a carrier transmitter connector and a carrier receiver connector, the carrier transmitter connector and the carrier receiver connector corresponding to the transmitter sensor connector and the receiver sensor connector of the connector ring.

Statement 10: A system is disclosed according to Statement 9, wherein the transmitter sensor connector and the receiver sensor connector are misaligned in the longitudinal direction.

Statement 11: A system is disclosed according to Statements 9 or 10, wherein the transmitter sensor connector is operable to connect with the transmitter sensor by coupling with a corresponding transmitter sensor cable.

Statement 12: A system is disclosed according to any of preceding Statements 9-11, wherein the receiver sensor connector is operable to connect with the receiver sensor by coupling with a corresponding receiver sensor cable.

Statement 13: A system is disclosed according to any of preceding Statements 9-12, wherein the first end of the transmitter sensor connector and the first end of the receiver sensor connector are staggered by a predetermined distance.

Statement 14: A system is disclosed according to any of preceding Statements 9-13, wherein the first end of the transmitter sensor connector is located further away from the body than the first end of the receiver sensor connector.

Statement 15: A system is disclosed according to any of preceding Statements 9-14, wherein the staggering of the transmitter sensor connector and the receiver sensor connector reduces crosstalk.

Statement 16: A system is disclosed according to any of preceding Statements 9-15, wherein the transmitter sensor connector is electronically coupled with the corresponding carrier transmitter connector, and the receiver sensor connectors is electronically coupled with the corresponding carrier receiver connector.

Statement 17: A system is disclosed according to any of preceding Statements 9-16, further comprising: a plurality of alignment connectors parallel to the longitudinal axis, the alignment connectors being operable to couple with corresponding alignment pins of the electronics carrier.

Statement 18: A method is disclosed comprising: disposing a connector ring in a downhole tool, the connector ring including: a body extending along a longitudinal axis; a transmitter sensor connector coupled with the body and extending parallel to the longitudinal axis, the transmitter sensor connector having a first end; a receiver sensor connector coupled with the body and extending parallel to the longitudinal axis, the receiver sensor connector having a first end, wherein the first end of the transmitter sensor connector and the first end of the receiver sensor connector are staggered along the longitudinal axis; coupling the transmitter sensor connector with a corresponding carrier transmitter connector of an electronics carrier; and coupling the receiver sensor connector with a corresponding carrier receiver connector of the electronics carrier.

Statement 19: A method is disclosed according to Statement 18, wherein the transmitter sensor connector and the receiver sensor connector are misaligned in the longitudinal direction.

Statement 20: A method is disclosed according to Statements 18 or 19, further comprising: coupling a first alignment connecter with a corresponding first alignment pin of the electronics carrier; and coupling a second alignment connector with a corresponding second alignment pin of the electronics carrier.

What is claimed is:

1. A connector ring for coupling to an electronics carrier, the connector ring comprising:

a body extending along a longitudinal axis;

a transmitter sensor connector coupled with the body and extending parallel to the longitudinal axis, the transmitter sensor connector having a first end; and a receiver sensor connector coupled with the body and extending parallel to the longitudinal axis, the receiver sensor connector having a first end, wherein the first end of the transmitter sensor connector and the first end of the receiver sensor connector are staggered along the longitudinal axis; and a plurality of alignment connectors parallel to the longitudinal axis, the plurality of alignment connectors being operable to couple with a corresponding plurality of alignment pins of the electronics carrier, wherein the plurality of alignment connectors are separate from the transmitter sensor connector and the receiver sensor connector to facilitate coupling between the connector ring and the electronics carrier and to avoid damage of the transmitter sensor connector and receiver sensor connector during coupling of the connector ring and the electronics carrier, and wherein the connector ring comprises a connecting region including a high shoulder and a low shoulder, and wherein at least one alignment connector of the plurality of alignment connectors is disposed on the high shoulder of the connecting region and at least one alignment connector of the plurality of alignment connectors is disposed on the low shoulder of the connecting region.

2. The connector ring of claim 1, wherein the transmitter sensor connector and the receiver sensor connector are misaligned in the longitudinal direction.

3. The connector ring of claim 1, wherein the first end of the transmitter sensor connector and the first end of the receiver sensor connector are staggered by a predetermined distance.

4. The connector ring of claim 1, wherein the first end of the transmitter sensor connector is located further away from the body than the first end of the receiver sensor connector.

5. The connector ring of claim 1, wherein the staggering of the transmitter sensor connector and the receiver sensor connector reduces crosstalk.

6. The connector ring of claim 1, wherein the connecting region includes a plurality of alignment connectors on the high shoulder and a plurality of alignment connectors on the low shoulder.

7. A system comprising:

a downhole tool disposed in a wellbore operable to make measurements of the wellbore, the downhole tool having a transmitter operable to transmit data from the downhole tool, and a receiver operable to receive data from a source external the downhole tool;

a connector ring coupled with the downhole tool, the connector ring comprising:

a connector ring body having a longitudinal axis, a transmitter sensor connector coupled with the connector ring body and extending parallel to the longitudinal axis, the transmitter sensor connector being coupled to a transmitter sensor, the transmitter sensor connector having a first end, and a receiver sensor connector coupled with the connector ring body and extending parallel to the longitudinal axis, the receiver sensor connector being coupled to a receiver sensor, the receiver sensor connector having a first end, wherein the first end of the transmitter sensor connector and the first end of the receiver sensor connector are staggered along the longitudinal axis; and an electronics carrier operable to be coupled with the connector ring, the electronics carrier including a carrier transmitter connector, and a carrier receiver connector, and a plurality of alignment pins separate from the carrier transmitter connector and carrier receiver connector, the carrier transmitter connector and the carrier receiver connector corresponding to the transmitter sensor connector and the receiver sensor connector of the connector ring, wherein the electronics carrier comprises a connecting region including a high shoulder and a low shoulder, and wherein at least one alignment pin of the plurality of alignment pins is disposed on the high shoulder of the connecting region and at least one alignment pin of the plurality of alignment pins is disposed on the low shoulder of the connecting region; and wherein the connector ring further comprises a plurality of alignment connectors parallel to the longitudinal axis, the plurality of alignment connectors being operable to couple with the plurality of alignment pins of the electronics carrier, wherein the plurality of alignment connectors are separate from the transmitter sensor connector and the receiver sensor connector to facilitate coupling between the connector ring and the electronics carrier and to avoid damage of the transmitter sensor connector and receiver sensor connector during coupling of the connector ring and the electronics carrier.

8. The system of claim 7, wherein the transmitter sensor connector and the receiver sensor connector are misaligned in the longitudinal direction.

9. The system of claim 7, wherein the first end of the transmitter sensor connector and the first end of the receiver sensor connector are staggered by a predetermined distance.

10. The system of claim 7, wherein the first end of the transmitter sensor connector is located further away from the connector ring body than the first end of the receiver sensor connector.

11. The system of claim 7, wherein the staggering of the transmitter sensor connector and the receiver sensor connector reduces crosstalk.

12. The system of claim 7, wherein at least one alignment pin of the plurality of alignment pins is made of a flexible material to allow for motion thereof during coupling of the connector ring and the electronics carrier.

13. The system of claim 7, wherein at least one alignment pin of the plurality of alignment pins extends further in the longitudinal direction than at least one of the carrier transmitter connector or a carrier receiver connector, such that the carrier transmitter connector is aligned with the transmitter sensor connector and the carrier receiver connector is aligned with the receiver sensor connector before coupling of the connector ring and the electronics carrier.

14. The system of claim 7, wherein the connecting connection region includes a plurality of alignment pins on the high shoulder and a plurality of alignment pins on the low shoulder.

15. The system of claim 7, wherein a first alignment connector of the plurality of alignment connectors provides a tighter connection for a corresponding alignment pin than a second alignment connector of the plurality of alignment connectors, such that greater alignment precision is required to confirm alignment for the first alignment connector than the second alignment connector.

16. The system of claim 7, wherein a first alignment pin of the plurality of alignment pins differs in shape from a second alignment pin of the plurality of alignment pins.

17. The system of claim 7, wherein a first alignment pin of the plurality of alignment pins differs in size from a second alignment pin of the plurality of alignment pins.

18. A method comprising:

disposing a connector ring in a downhole tool, the connector ring including:

a body extending along a longitudinal axis;

a transmitter sensor connector coupled with the body and extending parallel to the longitudinal axis, the transmitter sensor connector having a first end; and a receiver sensor connector coupled with the body and extending parallel to the longitudinal axis, the receiver sensor connector having a first end; and a plurality of alignment connectors parallel to the longitudinal axis, the plurality of alignment connectors being operable to couple with a corresponding plurality of alignment pins of an electronics carrier, wherein the plurality of alignment connectors are separate from the transmitter sensor connector and the receiver sensor connector to facilitate coupling between the connector ring and the electronics carrier and to avoid damage of the transmitter sensor connector and receiver sensor connector during coupling of the connector ring and the electronics carrier, wherein the electronics carrier comprises a connecting region including a high shoulder and a low shoulder, and wherein at least one alignment pin of the plurality of alignment pins is disposed on the high shoulder of the connecting region and at least one alignment pin of the plurality of alignment pins is disposed on the low shoulder of the connecting region, wherein the first end of the transmitter sensor connector and the first end of the receiver sensor connector are staggered along the longitudinal axis;

aligning the plurality of alignment connectors of the connector ring with the corresponding plurality of alignment pins of the electronics carrier;

coupling the transmitter sensor connectors with a corresponding carrier transmitter connector of the electronics carrier; and coupling the receiver sensor connector with a corresponding carrier receiver connector of the electronics carrier.

19. The method of claim 18, wherein the transmitter sensor connector and the receiver sensor connector are misaligned in the longitudinal direction.

20. The method of claim 18, further comprising:

coupling a first alignment connecter with a corresponding first alignment pin of the electronics carrier; and coupling a second alignment connector with a corresponding second alignment pin of the electronics carrier.

* * * * *